US008764349B2

(12) United States Patent
Onsori

(10) Patent No.: US 8,764,349 B2
(45) Date of Patent: Jul. 1, 2014

(54) GOB SHIELD FOR SHIELD SUPPORT AND METHOD FOR THE PRODUCTION THEREOF

(75) Inventor: Siamak Onsori, Dortmund (DE)

(73) Assignee: Caterpillar Global Mining Europe GmbH, Lunen (DE)

( * ) Notice: Subject to any disclaimer, the term of this patent is extended or adjusted under 35 U.S.C. 154(b) by 114 days.

(21) Appl. No.: 13/382,759

(22) PCT Filed: Jul. 1, 2010

(86) PCT No.: PCT/IB2010/053029

§ 371 (c)(1),
(2), (4) Date: Mar. 14, 2012

(87) PCT Pub. No.: WO2011/004296

PCT Pub. Date: Jan. 13, 2011

(65) Prior Publication Data

US 2012/0163926 A1 Jun. 28, 2012

(30) Foreign Application Priority Data

Jul. 8, 2009 (DE) ..... 10 2009 026 135

(51) Int. Cl.
*E21D 23/16* (2006.01)
*E21D 15/44* (2006.01)

(52) U.S. Cl.
USPC ..... 405/290; 405/288; 405/296

(58) Field of Classification Search
USPC ..... 405/288, 290, 291, 295, 296, 302.1
See application file for complete search history.

(56) References Cited

U.S. PATENT DOCUMENTS

| | | | | | |
|---|---|---|---|---|---|
| 4,037,419 | A | * | 7/1977 | Hill et al. | 405/293 |
| 4,041,715 | A | * | 8/1977 | Watermann et al. | 405/296 |
| 4,236,850 | A | * | 12/1980 | Koppers et al. | 405/291 |
| 4,268,193 | A | * | 5/1981 | Smith | 405/292 |
| 4,269,546 | A | * | 5/1981 | Saunders | 405/294 |
| 4,293,247 | A | * | 10/1981 | Rosenberg et al. | 405/296 |
| 4,607,986 | A | * | 8/1986 | Brown | 405/296 |
| 4,701,079 | A | * | 10/1987 | Meissner | 405/296 |
| 4,708,531 | A | | 11/1987 | Plenter | |

FOREIGN PATENT DOCUMENTS

| | | | |
|---|---|---|---|
| DE | 24 13 247 | A1 | 10/1975 |
| DE | 77 18 697 | U1 | 9/1977 |
| DE | 34 28 859 | C1 | 1/1986 |
| DE | 35 39 800 | A1 | 5/1987 |
| DE | 36 29 934 | C1 | 1/1988 |
| DE | 20 2007 009 841 | U1 | 9/2007 |

* cited by examiner

*Primary Examiner* — Benjamin Fiorello
(74) *Attorney, Agent, or Firm* — Foley & Lardner LLP

(57) ABSTRACT

A gob shield for a shield support and a method for producing such a gob shield. The gob shield having a cover plate, two cap connecting joints for connecting the gob shield to a roof cap, and side plate pairs having respectively two side plates with bolt receptacles for the fastening of links of a link mechanism to the gob shield. In order to simplify the production of the gob shield, each cap connecting joint is a component part of a separately producible elongate assembly, which, by a rear end, can be welded in place in the interspace between the side plates of a side plate pair before this master assembly comprising assembly and side plate pair is welded to the cover plate.

21 Claims, 6 Drawing Sheets

GOB SHIELD FOR SHIELD SUPPORT AND METHOD FOR THE PRODUCTION THEREOF

The invention relates to a gob shield for a shield support for underground mining, comprising at least one cover plate, comprising at least two cap connecting joints, by means of which a roof cap can be articulately attached to the gob shield, and comprising side plates, arranged in pairs and having bolt receptacles for the fastening of links of a link mechanism to the gob shield. In addition, the invention also relates to a method for producing a gob shield for a shield support for underground mining, wherein the gob shield has a cover plate, two cap connecting joints for articulately connecting the gob shield to a roof cap, and side plates, arranged in pairs and having bolt receptacles for connecting the gob shield to links of a link mechanism.

BACKGROUND OF THE INVENTION

In underground mining, in order to keep cavities for the secure arrangement of the mining machines in the so-called working face open, variable-height shield supports or shield support frames, which generally have two floor skids, a link mechanism with generally four links employed as a lemniscate system, a gob shield, and a roof cap articulately connected to the gob shield, are used. Through the extension of hydraulic cylinders, which support the roof cap with respect to the floor skids, the roof cap is pressed against the so-called roof, while the gob shield, at the rear or on the packing side of the mining plant, prevents the rock from caving in.

Numerous property right applications relate to the structure of the shield support, the designs of the floor skid and the structural design of the roof cap. The gob shield is here generally regarded only as a connecting link between the link mechanism and the roof cap and has been constructed and produced in exactly the same way for years.

SUMMARY OF THE INVENTION

An object of the invention is to improve the design of a gob shield for an underground shield support in order that the gob shield can be produced as cost-effectively as possible with modern production facilities and, at the same time, can also withstand higher flexural and torsional forces.

With respect to the gob shield, this object and others are achieved according to the invention by virtue of the fact that each cap connecting joint is a component part of a separately producible elongate assembly, which has on a front side a protrudingly configured bolt eye and has a flat bottom side for bearing contact against the cover plate and which reaches with a rear end into an interspace between the side plates of a side plate pair, wherein, according to choice, the elongate assembly is welded on by means of weld seams at the joints between the assembly and the side plates and is welded on the side plates and/or is welded on the cover plate by means of weld seams at the joints between the assembly and the cover plate. With respect to a method for producing a gob shield, the objects are achieved by virtue of the fact that each cap connecting joint is a component part of an elongate assembly, which is produced separately and has on a front side a protruding bolt eye, a flat bottom side and a rear end, which rear end of the assembly, in the production process, reaches into an interspace between the side plates of a side plate pair and is connected to the side plates and/or to the cover plate by means of weld seams.

In an advantageous method variant, the elongate assembly is firstly inserted into an interspace between the side plates of a side plate pair and connected to these by means of weld seams before the assembly and the side plate pair are welded as a subunit or master unit to the cover plate. It is also possible, however, for the elongate assembly to firstly be welded to the cover plate. The inventive solution comprises, as a fundamental feature of the solution, the formation of an elongate assembly such that not only is the bolt eye, on the front side of this assembly, configured for the connection of the roof cap, but that said assembly can be fastened with a flat bottom side to the cover plate in a relatively long region, in particular can be welded thereto by means of easily applicable weld seams. The gob shield is at the same time constructed such that the elongate assembly can be slid in or inserted with its rear end between the side plates of a side plate pair and, if necessary, also welded on there.

The welding together of the assembly and the side plate pair can be realized first, after which the intermediate or master assembly, consisting of the elongate assembly with the bolt eye and the side plate pair, can then be welded as a prefabricated subunit to the cover plate. This structure of a gob shield and such a procedure for use in the production of a gob shield lead to a considerable reduction in the number of individual parts which are needed to produce the gob shield; at the same time, the possibility is presented of creating relatively simply a dimensional stability between the bolt eye for the cap connecting joint, on the one hand, and the bolt receptacles for the fastening of the links, on the other hand, since this subunit or master assembly can be put together before the definitive fastening to the cover plate is realized. It is additionally ensured that the elongate assembly, on the one hand, and the side plate pair, on the other hand, can be connected to one another with a sufficient number of weld seams before, in a final step, this intermediate or master assembly, with weld seams, preferably with weld seams running along the outer walls of the elongate assembly and the side plates of each side plate pair, the intermediate assembly is welded and fastened to the cover plate. Alternatively, it is also possible, however, to firstly weld the prefabricated elongate assembly to the cover plate, and only then to apply the side plate pair to the cover plate such that the rear end of the assembly intrudes into the interspace. In this position, the side plate pair is then welded to the cover plate. If so desired, the weld joint between the assembly and the side plate pair can then also be applied.

The elongate assembly is preferably configured as a weldment, having two outer, flat metal strips which are connected by means of at least one cross brace and are hereby braced relative to each other. In a preferred embodiment, curved shell braces can then be welded in place between the metal strips, which shell braces achieve an additional bracing of the metal strips. In the particularly preferred inventive solution, the shell braces are arranged to both sides of the transverse web, and the assembly, preferably via weld seams connecting the edges of the shell braces to the inner sides of the flat metal strips, as well as to the transverse web or one to another, is configured to form a partially closed construction. The bottom edges of the metal strips here run preferably flat and thus form the bearing zone of the elongate assembly on the cover plate. In order with the elongate assembly to form the cap connecting joint in as simple a manner as possible, it is particularly advantageous if the metal strips respectively have a rounded front end, provided with a circular eye, so that, when the two circular eyes of two metal strips connected to form an elongate assembly are arranged in alignment, a suitable hinged bolt or pivot pin receptacle for a hinged bolt for connecting a roof cap to the gob shield is produced. An entire elongate assembly can consist of a small number of individual parts, preferably around five to eight individual parts, according to the number of shell braces used, whereby, all in all, a low production cost for the production of an elongate assembly is achieved. At the same time, the same assembly can respectively be produced separately and then used for the creation for each cap connecting joint.

A particularly simple structure of a gob shield is also achieved by virtue of the fact that, according to an advantageous embodiment, only a single transverse element is welded in place between the side plates of a side plate pair. The preferably just one transverse element then serves solely to be able to produce a side plate pair as an intermediate product, in which, with sufficiently high dimensional stability, the two side plates lie plane-parallel to each other and have a substantially predetermined interspace between them, which is sufficiently dimensioned to allow the elongate assembly to be slid in between the side plates. It is particularly advantageous if the transverse element consists of a curved metal piece, such as, for instance, a semicircular or semi-oval profile piece, which is respectively welded by the end faces to the inner sides of the side plates. The bottom edges of the curved metal piece can then at the same time, in the assembled state, rest on the cover plate and there, in turn, be welded on by means of weld spots, or preferably by means of continuous weld seams. In the side plates, a cut-out hole is respectively configured, preferably to both sides of the transverse element, as a bolt receptacle for the fastening of the links by means of link hinged bolts which can be placed into the holes. The holes of the bolt receptacle are preferably cut out prior to the welding of the elongate assembly to the side plate pair, depending on the procedure either before of after the connection of the side plates to form a side plate pair with interspace.

After firstly two master assemblies, respectively consisting of an elongate assembly and a welded-on side plate pair, have been welded to the cover plate, for the completion of the gob shield preferably rectangular stiffening plates are welded to the mutually facing side faces of the adjacent-situated side plates of the side plate pairs, which stiffening plates bear with a bottom edge against the cover plate and are welded on there. If at least three boundary edges of the stiffening plates stand at right angles to one another, it is possible with these, in a simple manner, to achieve a bracing of the gob shield between the side plates of the side plate pairs, so that the construction elements of the elongate assembly and of the side plate pairs at the same time form stiffening struts for the cover plate in the assembled state. A supporting bracket for attachment to a corner cylinder between the gob shield and the roof can further preferably be welded between two side plate pairs to the cover plate, wherein the supporting bracket preferably consists of a cast part. Further preferably, the stiffening plates and the supporting bracket can then be welded to a closing plate, which has cutouts for the partial reach-through of the stiffening plates and for a head of the supporting bracket.

In an alternative embodiment of an inventive gob shield, the bottom edges of the metal strips can be at least partially provided with deep bevels for the application of the weld seams between the metal strips and the cover plate, and/or the bottom edges of the side plates are at least partially provided with deep bevels for the reception of the weld seams between the elongate assembly and the cover plate. The provision of deep bevels hence enables, on the one hand, the application of relatively strong weld seams and, on the other hand, a tight interlocking of the elongate assembly and of the side plates, which overlap the latter, of the side plate pair, even when the weld seams between the elongate assembly and the cover plate laterally protrude. Further preferably, the, in the assembled state, inner-lying metal strips of the elongate assembly can be provided on their top side with a depression for the reception of an end plate, which extends from one outer-lying metal strip to the other outer-lying metal strip and is preferably welded to the latter.

In addition, the rear edges of the side plates can be provided with protruding bosses, wherein a closing web traversing the width of the cover plate is positioned and welded on between the bosses and the cover plate.

These and other objects, aspects, features, developments and advantages of the invention of this application will become apparent to those skilled in the art upon a reading of the Detailed Description of Embodiments set forth below taken together with the drawings which will be described in the next section.

BRIEF DESCRIPTION OF THE DRAWINGS

The invention may take physical form in certain parts and arrangement of parts, a preferred embodiment of which will be described in detail and illustrated in the accompanying drawings which form a part hereof and wherein.

DETAILED DESCRIPTION OF EMBODIMENTS

Figure 1:
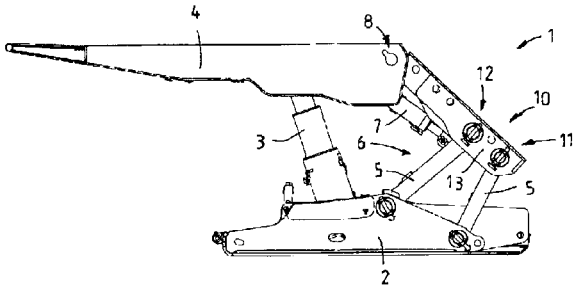
FIG. 1 shows a shield support for underground mining, with inventive gob shield, in side view.

Referring now to the drawings wherein the showings are for the purpose of illustrating preferred and alternative embodiments of the invention only and not for the purpose of limiting same, FIG. 1 shows a shield support for underground mining is represented in its entirety with reference symbol 1, with which shield support, in particular, the heading face, in which a mining machine, such as a scraper chain conveyor with attached machine guide, is disposed, can be kept open and, at the same time, the mining plant can be advanced. In a manner which is known per se, the shield support 1 has two mutually adjacent skids 2, which in underground mining are also referred to as floor skids, since they rest on the rock soil forming the floor of a face. On each floor skid 2 is respectively supported a multitelescopic strong hydraulic cylinder 3, which in underground mining is also referred to as a hydraulic prop and the cylinder head of which presses from below against a shield cap 4, which is referred to below, as usual in underground mining, as a roof cap, since it is pressed against the rock which forms the ceiling of the face, the so-called roof. The distance between the floor skids 2 and the roof cap 4 can be adjusted by retraction or extension of the hydraulic cylinders 3, wherein, by means of a link mechanism 6 respectively comprising two links 5, here configured as a lemniscate link mechanism, it is ensured by means of a gob shield 10, as well as by means of a corner cylinder 7, that the floor skids 2 and the roof cap 4, in each state of extension of the hydraulic cylinders 3, stand substantially plane-parallel to each other. The link mechanism 6 respectively has a front link 5 and a rear link 5, which are supported at a distance apart against two bolt receptacles 11 and 12 as well as against the skid 2. The bolt receptacles 11, 12 are respectively configured on a side plate 13 of the gob shield 10, and the roof cap 4 is connected to the gob shield 10 also by a hinge bolt (not represented here in detail), which can preferably be slid through the cutout 8 in the roof cap 4 into a cap connecting joint on the gob shield 10 in order to connect the gob shield 10 and the roof cap 4 articulately to each other. The corner cylinder 7, which is attached by its one end to a supporting bracket on the gob shield 10 and with its other end against the roof cap 4, serves for the additional bracing of the articulated connection between the gob shield 10 and the roof cap 4 and can be hydraulically loaded or unloaded, according to choice.

Figure 2:
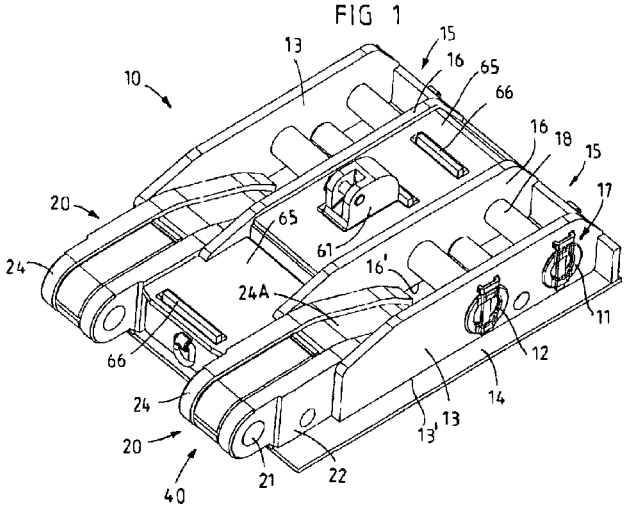
FIG. 2 shows in perspective representation a gob shield according to a first embodiment in a view from below at the end of a production process.

The invention essentially relates to the structure, the design and the method for producing the gob shield 10, and the gob shield 10 according to a first embodiment is represented with its individual parts in perspective view in FIG. 2, to which reference is now made. The gob shield 10 has a strong, in this case rectangular cover plate 14, which accounts for the entire length and breadth of the gob shield 10 and to the bottom side of which, related to the assembled state according to FIG. 1, the individual structural elements for the articulated attachment of the links of the corner cylinder and of the hinge bolt for the roof cap are attached or welded. From FIG. 2 it can clearly be seen that, on the bottom side of the cover plate 14, a first pair 15 of side plates 13, 16 and, at a lateral distance thereto, a second pair 15 of side plates 13, 16 is disposed, wherein respectively the outer-lying side plates are provided with the reference symbol 13 and the inner-lying side plates of each side plate pair 15 are provided with the reference symbol 16; the individual side plates can nevertheless be configured virtually identically to each other. To the outer sides of the outer side plates 13, however, locking devices 17 are respectively fastened, to allow link bolts 18 for the articulated connection of the links (5, FIG. 1) to be inserted between the side plates 13, 16 of each side plate pair 15 and secured against release.

While the rear bolt receptacles 11 are disposed close to the rear end of the side plates 13, 16 or of the cover plate 14, the cap connecting joint 21, through which a hinge bolt for connecting the roof cap (4, FIG. 1) to the gob shield 10, can be slid, projects over the front edge of the cover plate 14. A particularity of the inventive gob shield 10 consists in the fact that the cap connecting joint 21 is disposed at the front end 24 of an assembly 20 which bears with its flat bottom side 22 against the cover plate 14 and is welded in place there and which reaches with its rear end 24A into the interspace between the side plates 13, 16 and, by means of weld seams (not shown) in the joints between the assembly 20 on the one hand and the side plates 13, 16 on the other hand, is welded to the latter. As a result of the welded connection of the assembly 20 to the side plates 13, 16, a master assembly 40, consisting of the rigidly mutually connected side plates 13, 16, and the assembly 20 having the cap connecting joint 21 at the front end, can be produced in a first method step.

Figure 3A:
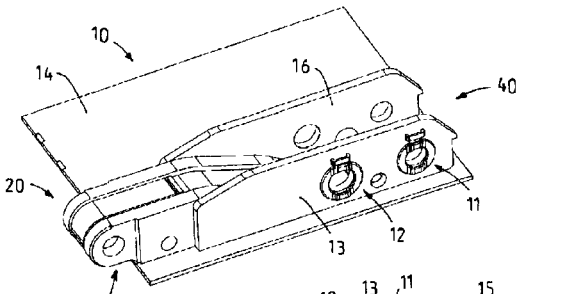
FIG. 3A, 3B, 3C show the main method steps according to a first inventive procedure followed in the production of the gob shield from FIG. 2.
Figure 4:
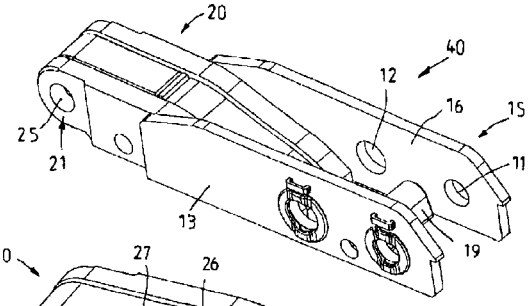
FIG. 4 shows the prefabricated master assembly used in the production of the gob shield according to FIG. 2.

For further clarification, reference is now made to FIG. 4, in which the master assembly 40 is represented in detail, as well as to FIG. 3A, which shows the first step in the production of an inventive gob shield 10. In FIG. 3A, one of a total of two master assemblies 40 is already welded to the bottom side of the cover plate 14. In particular, FIG. 4 clearly reveals that the master assembly 40 consists, on the one hand, of the assembly 20, which is provided at its front end 24 with the cap connecting joint 21, and, on the other hand, of the side plate pair 15, wherein the side plates 13, 16 are braced by means of a transverse element 19 to form a rigid subassembly, before the assembly 20 is connected with its rear end 24A to the side plate pair 15 via weld seams. Since, on the one hand, the subassembly 20 and, on the other hand, the side plate pair 15 can be produced separately and can then be put together to form an intermediate or master assembly 40 before this master assembly 40 is detained on the side plate 14, as represented in FIG. 3A, via weld seams, it is possible to set the exact distance between the center axes of the cap connecting joint 21 and the center axes of the bolt receptacles 11, 12 before the master assembly 40 is welded to the cover plate 14. A further advantage of this procedure lies in the fact that the master assembly 40 per se is firstly braced and, in this respect, can form a stiffening element for the cover plate 14, at the same time as the possibility is given for the connection between the master assembly 40 and the cover plate 14 to be made essentially solely via longitudinal seams, which are placed along the flat bottom side 22 of the assembly 20 and along the bottom edges 13', 16' of the side plates 13, 16. The application of a longitudinal weld seam can be realized substantially more easily than individual spot weldings and at the same time ensures a better connection to the cover plate 14 and higher rigidity of the gob shield 10.

Figure 3B:
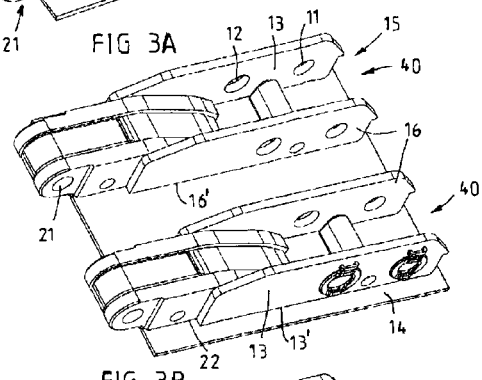
Figure 3C:
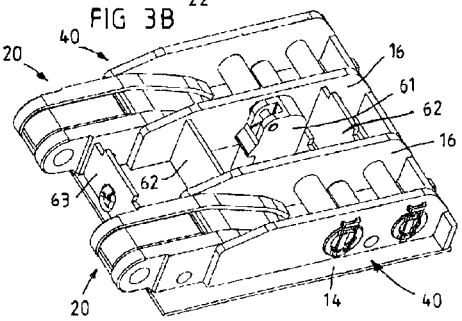

This is also illustrated by FIG. 3B, in which both subassemblies 40, with all bolt receptacles 11, 12 and with the cap connecting joint 21 protruding over the front edge of the cover plate 14, have already been fastened to the cover plate 14 via longitudinal weld seams. In particular, the bottom edges 13', 16' of the side plates 13, 16 are free and easily accessible for placement of the longitudinal weld seams, including with a welding robot if necessary. As shown in FIG. 3C, only in a next production step is a supporting bracket 61 for connecting the corner cylinder (7, FIG. 1) to the bottom side of the cover plate 14 welded on between the inner side plates 16, and a plurality of in this case rectangular stiffening plates 62 are welded in place, at a distance apart, between the inner-lying side plates 16, in order once again to perform an additional bracing and in order to be able to weld on closing plates 65 which are arranged at a distance to the cover plate 14 and thus brace the entire gob shield 10 to form a box construction. Further stiffening plates 63 can also be welded in place directly between the assemblies 20 of each master assembly 40, and each stiffening plate preferably has three mutually perpendicular edges. In order also to enable the closing plates 65 to be welded on easily, these are provided with slits 66, through which the stiffening plates 62, 63 partially project with ribs on the exposed top edge.

Figure 7:
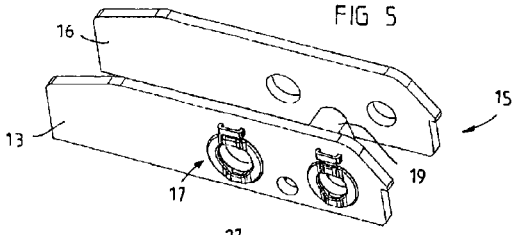
FIG. 7 shows a subassembly for producing the master assembly from FIG. 4.
Figure 8:
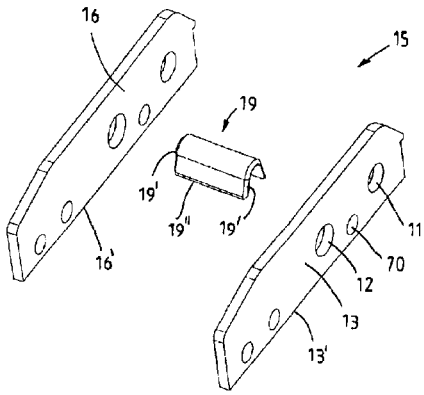
FIG. 8 shows the main elements of the subassembly according to FIG. 7 in exploded representation.

A further design simplification of the gob shield 10 is achieved by the relatively simple structure of the assembly 20 bearing the cap connecting joint 21, on the one hand, and of the side plate pair 15, which is to be braced separately from the cover plate 14, on the other hand. The extremely simple structure of the side plate pair 15 is particularly clearly apparent from FIGS. 7 and 8. As shown, the single element for rigidly connecting the side plates 13, 16 of a side plate pair 15 one to another consists of a transverse element 19, which, as FIG. 8 clearly reveals, consists of a curved metal piece, the end faces 19' of which can respectively be welded to the inner sides of that side plate 13 respectively situated on the outside of the gob shield, on the one hand, and of the inner-lying side plate 16, on the other hand, and the bottom edge 19" of which can terminate flush with the bottom sides 13', 16' of the side plates 13, 16, in order also to be able to weld the transverse piece 19, in the assembled state of a master assembly (40, FIG. 3), to the cover plate of the gob shield. As shown particularly clearly by FIG. 8, the bolt receptacles 11, 12 can be cut out in the side plates 13, 16 prior to their connection to form a side plate pair 15, in order that an exact mutual spacing of the center axes of the two bolt receptacles 11, 12 can be observed before the transverse piece 19 is welded in place between the side plates 13, 16. In order to facilitate the welding in place, a round hole 70 can be recessed between the two bolt receptacles 11, 12, through which hole an additional bolt, for example for the fastening of a gap cover, or, if necessary, a weld seam can be applied. Moreover, as shown in FIG. 7, the locking devices 17 can be fastened to the side plate pair 15, in particular to the outer side plate 13, before the side plate pair 15 is connected by weld seams to the assembly (20, FIG. 5) to form a master assembly.

Figure 5:
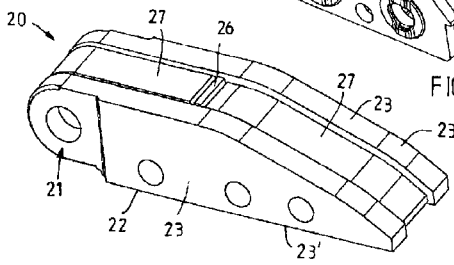
FIG. 5 shows in perspective representation the elongate assembly with cap connecting joint.
Figure 6:
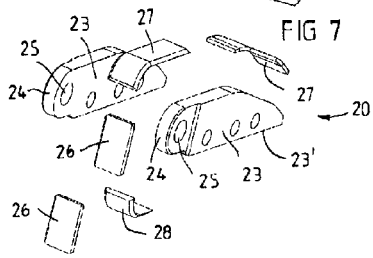
FIG. 6 shows the assembly from FIG. 5 in exploded representation.

The assembly 20 also has a structure of similarly simple design, as becomes clear from FIGS. 5 and 6. Each assembly 20 is configured as a weldment and has two outer, flat metal strips 23, which could also consist of cast parts or castings and have a rounded front end 24 provided centrally with a circular eye 25, wherein both eyes 25 together form, in the assembled state of the assembly 20, the cap connecting joint (21; FIG. 3). The bottom edges 23' of the metal strips 23 are flat, in order that each metal strip 23, and thus also the assembly 20, rest on the cover plate of the gob shield and can be welded on via longitudinal weld seams. The exact distance between the two metal strips 23, and the bracing thereof, is achieved by means of cross braces 26, which are respectively welded to the inner sides of the metal strips 23. With the exception of the region of the flat bottom edges 23' of the metal strips 23, the assembly 20 is braced by means of curved shell braces 27, 28 to form a partially closed construction, wherein the shell braces 27 can in part bear against the cross braces 26 so as to be welded to the cross braces 26, or be able to rest on these, in order to position the shell braces exactly on the assembly 20. This is shown particularly clearly by FIG. 5, in which only one of the two cross braces 26 can be seen, with a shell brace 27 respectively extending to both sides thereof. The rear end 24A of the assembly 20 tapers to a point and narrows, since the top edges 23" of the metal strips 23 run obliquely to the flat bottom edges 23'. The distance between the outer sides of the metal strips 23 is dimensioned such that the assembly 20 can be inserted with small motional play between the side plates 13, 16 of a side plate pair 15, as shown in FIG. 2, and can be welded on there such that the bottom edges 23' of the metal strips 23 are aligned with the bottom edges 13', 16' of the side plates 13, 16. The connecting weld seams of the assembly 20 to the side plate pair 15 here lie preferably along the top edge 23" of the metal strips 23, in order that the entire bottom side of the master assembly 40 can be placed in plane-parallel arrangement on the cover plate 14 without weld seams or the like having to be reworked.

FIGS. 9 to 12 show an inventive gob shield 110 according to a second illustrative embodiment, and a method, which is slightly modified in relation to the above-described procedure, for producing this gob shield 110. In respect of the gob shield 110, functionally identical components are denoted by reference symbols which are higher by a figure of 100 than in the previous illustrative embodiment. The gob shield 110 has a strong, rectangular cover plate 114, which accounts for the entire length and breadth of the gob shield 110 and to the bottom side of which a first pair 115 of side plates 113, 116 and, at a lateral distance hereto, a second pair 115 of side plates 113, 116 is welded. While the bolt receptacles 111, 112 for the link connection are disposed close to the rear end of the side plates 113, 116 or of the cover plate 114, the cap connecting joint 121, through which a hinge bolt for connecting the roof cap (4, FIG. 1) to the gob shield 110 can be slid, projects over the front edge of the cover plate 114. According to the invention, in the gob shield 110 the cap connecting joint 121 is disposed at the front end 124 of an assembly 120, which bears with its flat bottom side 122 against the cover plate 114 and is welded in place there. The rear end 124A of the assembly 120 reaches or intrudes into the interspace between the side plates 113, 116 and can there be welded to the side plates 113, 116 by means of weld seams (not shown) guided along the butt joints.

The basic structure of the separately produced assembly 120 and of the separately produced side plate pair 115 is similar to that in the previous illustrative embodiment. As can be seen clearly from FIG. 11, each assembly 120 is configured as a weldment and has two outer, flat metal strips 123, the front end 124 of which is rounded and is provided centrally with a circular eye 125 for the formation of the cap connecting joint. The bottom edges 123' of the metal strips 123 are flat, in order that each metal strip 123, and thus also the assembly 120, rest with their flat bottom side 122 on the cover plate of the gob shield and can be welded to the cover plate via longitudinal weld seams. In order to improve the application of the weld seam, the bottom edge 123' of the metal strips 123 is provided at the margins, at least on the outer sides, with a relatively deep bevel 129 or chamfer, which extends preferably only partially over the front region of the bottom edge 123' of the metal strips 123. The spacing between the two metal strips 123, and the bracing thereof, is achieved by means of cross braces 126, which are respectively welded to the inner sides of the metal strips 123. The prefabricated assembly 120 is initially closed only by means of one or more curved shell braces 127 in the region of the front end 124, wherein these shell braces 127 are welded in place between the metal strips 123 and, if necessary, can also bear against and be welded to cross braces. The rear end 124A of the assembly 120 tapers to a point and narrows, since the top edges 123" of the metal strips 123 run obliquely to the flat bottom edges 123' or to the bottom side 122 of the assembly 120. In the region of the rear end 124A, the gap between the metal strips 123 remains open at least until the assembly 120 is welded to the cover plate.

Figure 12:
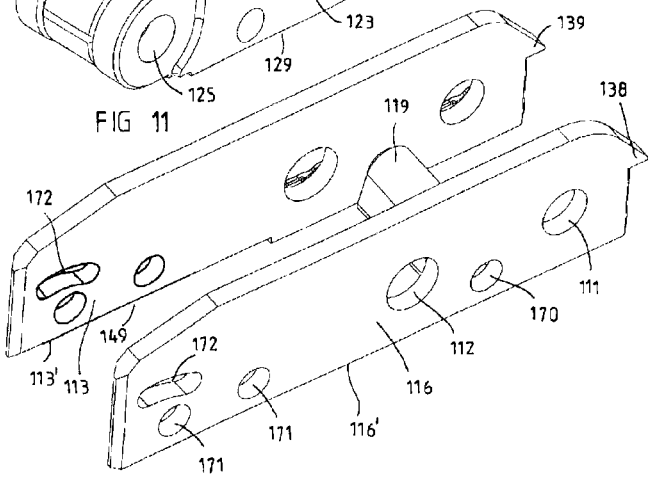
FIG. 12 shows in perspective representation the side plate pair as a subassembly in the gob shield according to the second embodiment.

As can be seen clearly from FIG. 12, the prefabricated side plate pair 115 substantially consists only of the side plates 113, 116 and of a transverse element 119 connecting these, which transverse element is respectively welded to the inner sides of the side plates 113, 116 and defines the width of the interspace. The bottom sides 113', 116' of the side plates 113, 116 are provided at least in the front region with deep bevels 149 or chamfers or, if necessary, recesses, in order, as will be further explained, to receive protrusions of a weld seam, with which the assembly 120 is welded to the cover plate, before the side plate pair 115 is slid over the first assembly such that the rear end of the assembly intrudes and reaches into the interspace between the side plates 113, 116. The bolt receptacles 111, 112 in the side plates 113, 116 can be cut out already prior to the connection thereof to form a side plate pair 115. Between the two bolt receptacles 111, 112, a round hole 170 is recessed, through which, for example, a bolt can be slid as the locking mechanism for a gap cover. In addition, both side plates, or at least one of the side plates 116, are provided with round cutouts 171 for the insertion of bolts and/or of a kidney-shaped cutout 172 in order to be able to apply additional weld seams for connecting the side plate pair 115 to the assembly 120.

In principle, it would also be possible in the gob shield 110 to firstly produce in a first method step, by means of a welded connection between the assembly 120 and the side plates 113, 116, a master assembly, which is then, as a rigid unit of side plate pair and assembly, welded to the cover plate. In respect of the gob shield 110, an alternative production method is preferably used, however, which is now explained with additional reference to FIG. 10A, 10B, 10C.

Figure 10A:
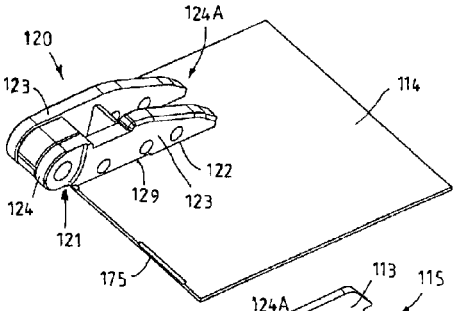
FIG. 10A,10B,10C show the main method steps according to a second inventive procedure followed in the production of the gob shield from FIG. 9.
Figure 10B:
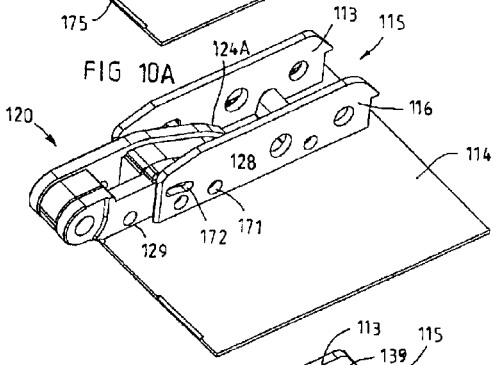
Figure 10C:
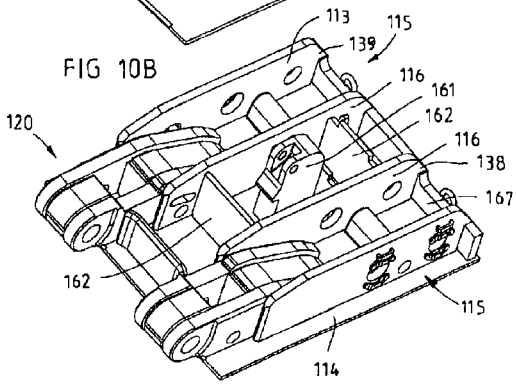
Figure 11:
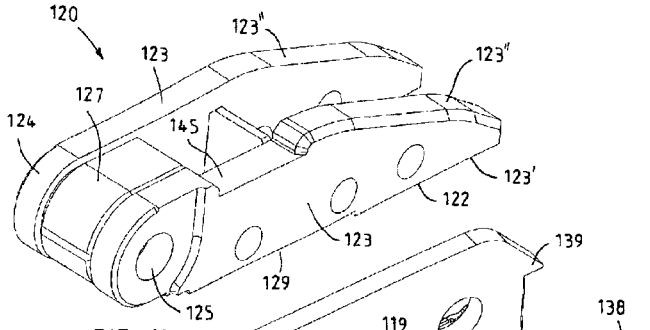
FIG. 11 shows in perspective representation the elongate assembly with cap connecting joint in the gob shield according to the second embodiment.

In a first method step, as shown in FIG. 10A, firstly just the assembly 120 is welded to the bottom side of the cover plate 114 such that the front end 124 projects with the cap connecting joint 121 over the front side of the cover plate 114. The front side of the cover plate can be provided with a chamfer or bevel 175 in order that, after the assembly 120 has been placed with the bottom side 122 on the cover plate 114, a weld seam can be applied also between the front side of the cover plate 114 and the assembly 120. Since the gap between the metal strips 123 at the rear end 124A is open, weld seams can be applied there too, i.e. in the gap or to the joints on the inner sides of the metal strips, in order to obtain a close connection between the bottom side 122 of the assembly 120 and the cover plate 114 with weld seams which are relatively easy to apply. The outer sides of the metal strips 123 are preferably welded to the cover plate 114 over the whole of their edge length with weld seams. In the front half of the bottom sides of the metal strips, deep bevels 129 are provided in order to apply there the weld seams with large weld bead without excessive protrusion over the side faces of the metal strips, while the rear half of the assembly, if necessary, can be welded to the cover plate with fillet welds. In the next method step, the side plate pair 115 is then, as shown by FIG. 10B, slid from behind onto the rear end 124A of the assembly 120 such that the rear end 124A of the assembly intrudes into the interspace between the side plates 113, 116. Owing to the deep bevels 149 configured on the mutually facing inner sides of the side plates 113, 116, the side plate pair 115 is not prevented from being slid on, even if the weld seams applied in the deep bevels 129, due to weld remnants or large material thickness, laterally overhang the metal strips 123. After this, the side plates 113, 116 can be welded to the cover plate 114 and further weld seams can be applied through the kidney-shaped cutout 172 in order to create a virtually rigid bond between the assembly 120, the side plate pair 115 and the cover plate 114. A gently curved shell brace 128, which covers the gap at the rear end 124A, is preferably only welded to the assembly 120 once this is welded to the cover plate 114. After the first subassembly consisting of the assembly 120 and the side plate pair 115 has been appropriately welded on, the second subassembly can be welded on with the same sequence of steps.

Only after this are the stiffening plates 162 respectively welded in place between the two inner or inner-lying metal strips 116 of the two side plate pairs 115. To the rear end of the cover plate 114 can be welded a closing web 167, which preferably consists of a one-piece bar which extends over the total width of the cover plate 114 and, in the assembled state, undergrips bosses 138 on the rear sides of the side plates 113, 116. A bracket 116, to which a corner cylinder can be fastened, is in turn welded in place between the inner-lying side plates 116.

Figure 9:
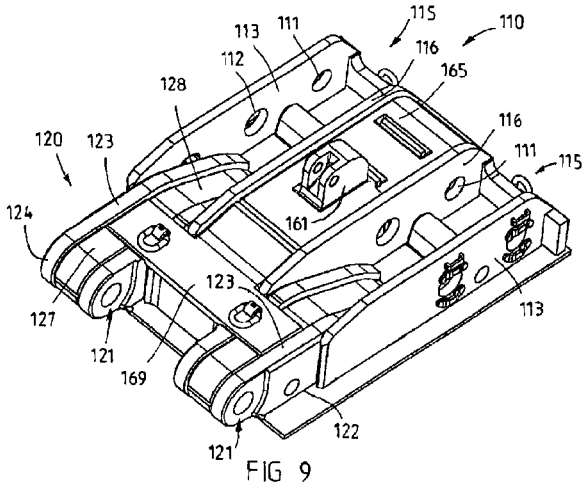
FIG. 9 shows in perspective representation a gob shield according to a second embodiment in a view from below at the end of a production process.

As can be seen particularly clearly from FIG. 9, in the gob shield 110, too, the whole of the region between the side plates 116 is closed off by means of closing plates 165, wherein the supporting bracket 161 for a corner cylinder protrudes through an opening. Unlike the previous illustrative embodiment, the two assemblies 120 are covered, however, by an end plate 169, which respectively extends from one, outer-lying metal strip 123 of one assembly 120 to the outer-lying metal strip 123 of the other assembly 120 and can also intrude with a segment rearward into the interspace between the two metal strips 116. In the represented illustrative embodiment, the end plate 169 respectively lies flush with the shell braces 127, 128, since, as can be seen clearly from FIG. 11, the inner-lying metal strip 123 is respectively provided on the middle of its top side 123" with a depression 145. As a result of additional weld seams between the end plate 169 and, in particular, the outer-lying metal strips 123, an additional bracing can be achieved.

For the person skilled in the art, numerous modifications which should fall within the scope of the appended claims emerge from the preceding description. The shaping of the assembly comprising the cap connecting joint, and that of the side plate pair, can be altered without departing from the scope of the appended claims. Self-evidently, the bracing of the individual elements could also be realized with a greater or lesser number of individual parts. Of course, still more elements could also be used to brace the subassemblies relative to one another or to produce an individual subassembly or assembly, and the position and distance of the cap connecting joint and of the bolt receptacles relative to one another can vary. The sequence in the connection of the individual construction elements and subassemblies one to another can also vary.

Further, while considerable emphasis has been placed on the preferred embodiments of the invention illustrated and described herein, it will be appreciated that other embodiments, and equivalences thereof, can be made and that many changes can be made in the preferred embodiments without departing from the principles of the invention. Furthermore, the embodiments described above can be combined to form yet other embodiments of the invention of this application. Accordingly, it is to be distinctly understood that the foregoing descriptive matter is to be interpreted merely as illustrative of the invention and not as a limitation.

The invention claimed is:

1. A gob shield for a shield support for underground mining, the gob shield comprising:

at least one cover plate, the cover plate having at least two cap connecting joints, the cap connecting joints configured to articulately attach an associated roof cap to the gob shield;

side plates, arranged into two or more side plate pairs and having bolt receptacles configured for the fastening of links of a link mechanism to the gob shield;

wherein each cap connecting joint is a component part of an elongate assembly, the elongate assembly comprising:

a front end having a protruding bolt eye, a flat bottom side for bearing contact against the cover plate, and a rear end extending into an interspace between the side plates of a side plate pair; and wherein the elongate assembly is at least one of (a) welded to the side plates by weld seams at joints between the elongate assembly and the side plates, and (b) welded to the cover plate by weld seams at joints between the assembly and the cover plate.

2. The gob shield as claimed in claim 1, wherein the elongate assembly is configured as a weldment having two outer, flat metal strips, which are braced relative to each other by at least one cross brace.

3. The gob shield as claimed in claim 2, wherein curved shell braces are welded in place between the flat metal strips.

4. The gob shield as claimed in claim 3, wherein the shell braces are arranged to both sides of the at least one cross brace to form a partially closed construction.

5. The gob shield as claimed in claim 2, wherein bottom edges of the flat metal strips run flat and form the bearing zone on the cover plate.

6. The gob shield as claimed in claim 2, wherein the flat metal strips respectively have a rounded front end, provided with a circular eye.

7. The gob shield as claimed in claim 2, wherein at least one of the bottom edges of the metal strips and the bottom edges of the side plates include bevels for the application of the weld seams with the cover plate.

8. The gob shield as claimed in claim 2, wherein the two outer flat metal strips of the elongated assembly are an inner-lying metal strip and an outer-lying metal strip, in the assembled state, the inner-lying metal strip being provided on a top side with a depression for the reception of an end plate, which extends from one outer-lying metal strip to the other outer-lying metal strip.

9. The gob shield as claimed in claim 1, wherein at least one transverse element is welded in place between the side plates.

10. The gob shield as claimed in claim 9, wherein the at least one transverse element is formed by a curved metal piece, which is welded by its end faces to inner sides of the side plates.

11. The gob shield as claimed in claim 9, wherein in the side plates to both sides of the transverse element there is respectively configured a cut-out hole as a bolt receptacle for the fastening of the links by way of associated link hinge bolts insertable into the cut out holes.

12. The gob shield as claimed in claim 1, wherein to the mutually facing side faces of the side plates of adjacent side plate pairs are welded rectangular stiffening plates, which bear with a bottom edge against the cover plate and are welded thereto.

13. The gob shield as claimed in claim 12, wherein to the cover plate between two side plate pairs is welded a supporting bracket for fastening an associated corner cylinder between the gob shield and the associated roof cap, the stiffening plates and the supporting bracket are welded to a closing plate.

14. The gob shield as claimed in claim 13, wherein closing plate includes at least one of an opening for the partial reach-through of at least one of the stiffening plates and an opening for the partial reach-through of a head of the supporting bracket.

15. The gob shield as claimed in claim 1, wherein to the cover plate between two side plate pairs is welded a supporting bracket for fastening an associated corner cylinder between the gob shield and the associated roof cap.

16. The gob shield as claimed in claim 15, wherein the supporting bracket is a cast part.

17. The gob shield as claimed in claim 1, wherein the rear edges of the side plates are provided with protruding bosses, wherein a closing web traversing the width of the cover plate is positioned and welded on between the bosses and the cover plate.

18. A method for producing a gob shield for shield supports for underground mining, wherein the gob shield has a cover plate, side plates arranged into at least two pairs, two cap connecting joints for articulately connecting the gob shield to an associated roof cap, and bolt receptacles arranged in pairs, for connecting the gob shield to associated links of an associated link mechanism, the method including the steps of:

producing each cap connecting joint as a component part of an elongate assembly, in which the elongate assembly is produced separately and has at a front end a protruding bolt eye, a flat bottom side and a rear end, which rear end of the assembly reaches into an interspace between the side plates of at least one of the side plate pairs; and connecting the elongate assembly to at least one of the side plates and to the cover plate by weld seams.

19. The method as claimed in claim 18, further including the steps of inserting the rear end of the elongate assembly into the interspace between the side plates of the at least one of the side plate pairs and welding the elongated assembly and the side plate pair together before welding the elongate assembly to the cover plate.

20. The method as claimed in claim 18, wherein the elongate assembly is firstly welded to the cover plate before positioning the rear end into the interspace between the side plates and before connecting the elongate assembly to the side plates.

21. The method as claimed in claim 18, wherein the elongate assembly is a first elongate assembly, the method further including connecting a second elongate assembly to at least one of the side plates and to the cover plate by weld seams and spaced from the first elongate assembly, welding a stiffening plate between the mutually facing side faces of the side plates of the first and second elongate assemblies and to the cover plate.

* * * * *